US008820983B2

(12) United States Patent
Schmitt et al.

(10) Patent No.: US 8,820,983 B2
(45) Date of Patent: Sep. 2, 2014

(54) DOWNLIGHT SUPPORT

(71) Applicants: Robert Schmitt, Nottingham, NH (US); Hongbiao Hou, Xiamen (CN)

(72) Inventors: Robert Schmitt, Nottingham, NH (US); Hongbiao Hou, Xiamen (CN)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 13/680,206

(22) Filed: Nov. 19, 2012

(65) Prior Publication Data

US 2014/0140075 A1 May 22, 2014

(51) Int. Cl.

| | |
|---|---|
| ***F21V 15/00*** | (2006.01) |
| ***F21V 21/04*** | (2006.01) |
| *F21S 8/02* | (2006.01) |

(52) U.S. Cl.

CPC ..... *F21V 21/045* (2013.01); *F21S 8/026* (2013.01)

USPC ..... 362/364; 362/365

(58) Field of Classification Search

USPC ..... 362/364–365

See application file for complete search history.

(56) References Cited

U.S. PATENT DOCUMENTS

| | | | | |
|---|---|---|---|---|
| 5,548,499 | A * | 8/1996 | Zadeh | 362/366 |
| 6,082,878 | A * | 7/2000 | Doubek et al. | 362/365 |
| 6,431,723 | B1 | 8/2002 | Schubert et al. | |
| 7,311,425 | B2 | 12/2007 | Jervey, III | |
| 7,628,504 | B2 | 12/2009 | Glickman | |
| 7,677,766 | B2 | 3/2010 | Boyer | |
| 7,845,832 | B2 | 12/2010 | Boyer | |
| 7,909,487 | B1 | 3/2011 | Venetucci | |
| 8,096,686 | B2 | 1/2012 | Wilcox | |
| 2002/0172047 | A1 | 11/2002 | Ashley | |
| 2010/0296685 | A1 | 11/2010 | Carle, Jr. et al. | |
| 2011/0134650 | A1 * | 6/2011 | Verma et al. | 362/362 |

* cited by examiner

*Primary Examiner* — Sean Gramling

(74) *Attorney, Agent, or Firm* — Shaun P. Montana; William H. McNeill

(57) ABSTRACT

A downlight support to enable installation of a downlight luminaire within a fixture is provided. The support includes has a tubular band. The tubular band has a first section, having a first diameter, and a second section, having a second diameter. The first diameter and the second diameter are arrayed about a longitudinal axis. A plurality of leaf springs is positioned on the second diameter. Each leaf spring in the plurality of leaf springs extends parallel to the longitudinal axis. A plurality of pairs of tension spring receptors is arrayed about the first diameter. Each pair of tension spring receptors extends inwardly toward the longitudinal axis.

4 Claims, 4 Drawing Sheets

DOWNLIGHT SUPPORT

TECHNICAL FIELD

The present invention relates to lighting, and more specifically, to attachments for light sources within recessed fixtures.

BACKGROUND

With the continuing proliferation of lamps and luminaires including solid state light sources, luminaires are being used to replace lamps in some fixtures, particularly in recessed fixtures. Many recessed fixtures include attachment mechanisms that receive one or more tension springs. Thus, many solid state light source luminaires include tension springs for installation into a recessed fixture.

SUMMARY

Not all recessed fixtures allow for installation via use of tension springs. For example, during installation, an installation might have removed the clips or other attachment mechanism that would receive tension springs. Some recessed fixtures simply do not include such attachment mechanisms. Thus, a variety of techniques to enable installation of solid state light source luminaires into such recessed fixtures have been developed. However, these techniques for supporting a luminaire in a recessed fixture are usually complicated and difficult to install. Typically, these techniques require more than one person engaged at ceiling height upon a ladder.

Embodiments of the present invention provide for a support for a luminaire, to enable installation of the luminaire in a fixture, such as but not limited to a recessed fixture. The support is simple to attach to the luminaire, and combination of the support and the luminaire is easy to install with the fixture. A downlight support according to embodiments described herein includes a tubular band having a first section with a first diameter and a second section with a second diameter. The diameters are arrayed about a longitudinal axis. A plurality of leaf springs is positioned on the second section and these leaf springs extend parallel to the longitudinal axis. A plurality of tension spring receptors is arrayed about the first section and these tension spring receptors extend inwardly toward the longitudinal axis. The tubular band is installed on the luminaire first, and then the luminaire is easily installed directly into the previously mounted ceiling fixture.

In an embodiment, there is provided a downlight support for a lighting fixture. The downlight support includes: a tubular band having a first section with a first diameter and a second section with a second diameter, the first diameter and the second diameter being arrayed about a longitudinal axis; a plurality of leaf springs positioned on the second diameter and extending parallel to the longitudinal axis; and a plurality of tension spring receptors arrayed about the first diameter and extending inwardly toward the longitudinal axis.

In a related embodiment, each of the tension spring receptors may include a pair of spaced-apart receptacles, and each receptacle in the pair of spaced-apart receptacles may be configured to receive a portion of a tension spring. In a further related embodiment, each receptacle may be a U-shaped clip, and each U-shaped clip may be configured to receive a portion of a tension spring.

In another related embodiment, each of the leaf springs may include an elongated, substantially flat portion affixed to a side of the first section and an engaging end having a projection extending away from the longitudinal axis.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
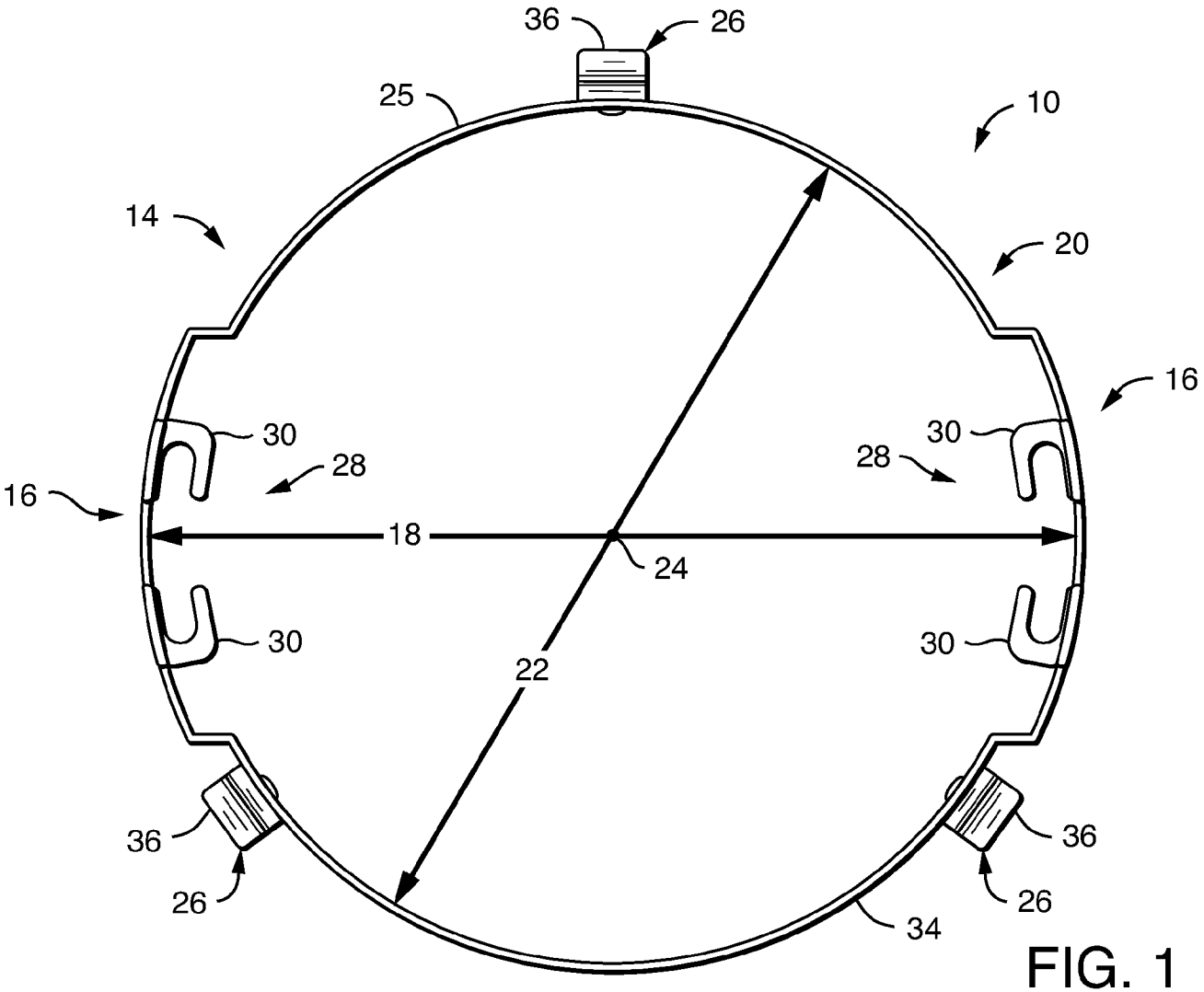
FIG. 1 shows a plan view of a downlight support according to embodiments disclosed herein.
Figure 2:
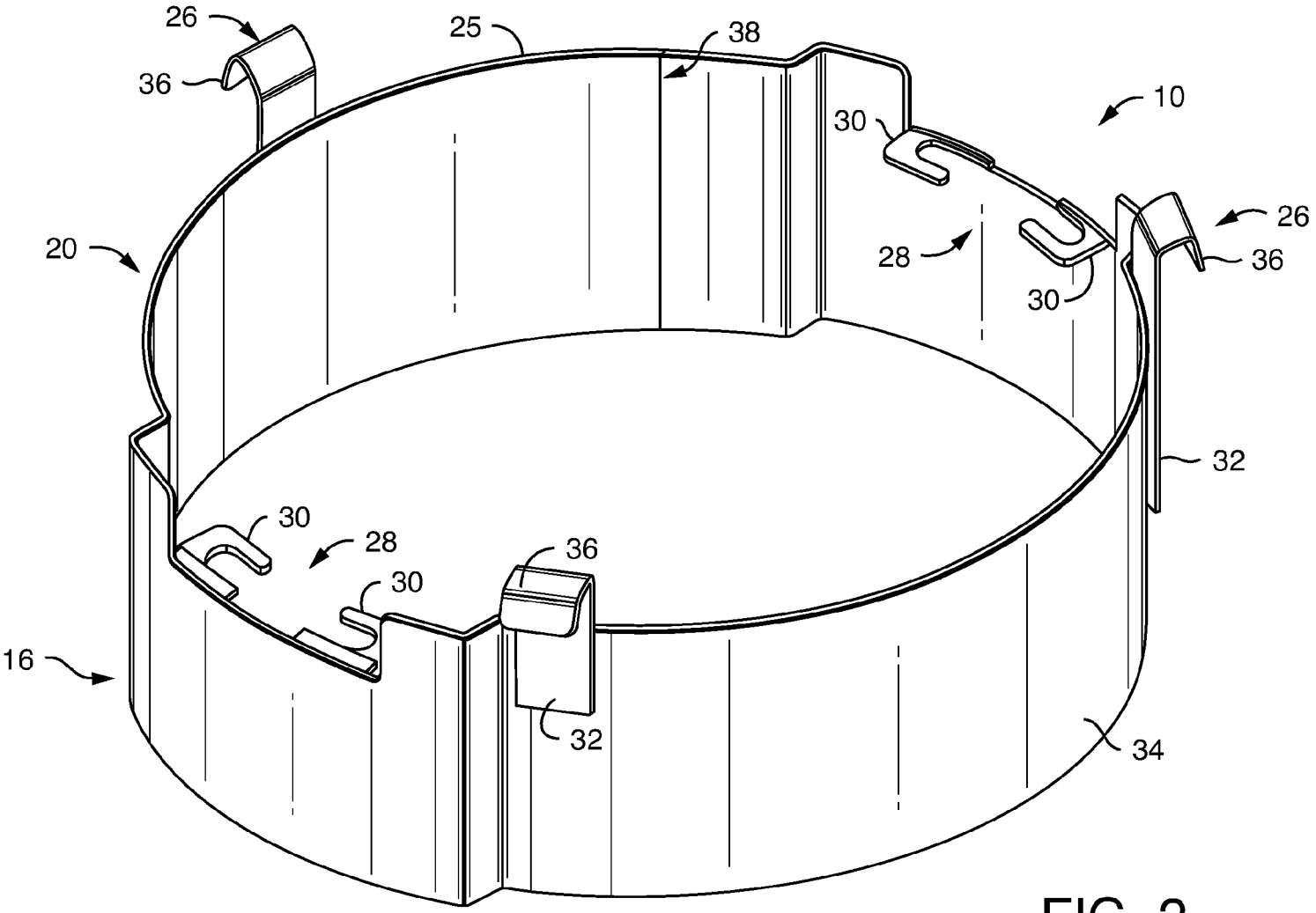
FIG. 2 is a perspective view of the downlight support of FIG. 1 according to embodiments disclosed herein.
Figure 3:
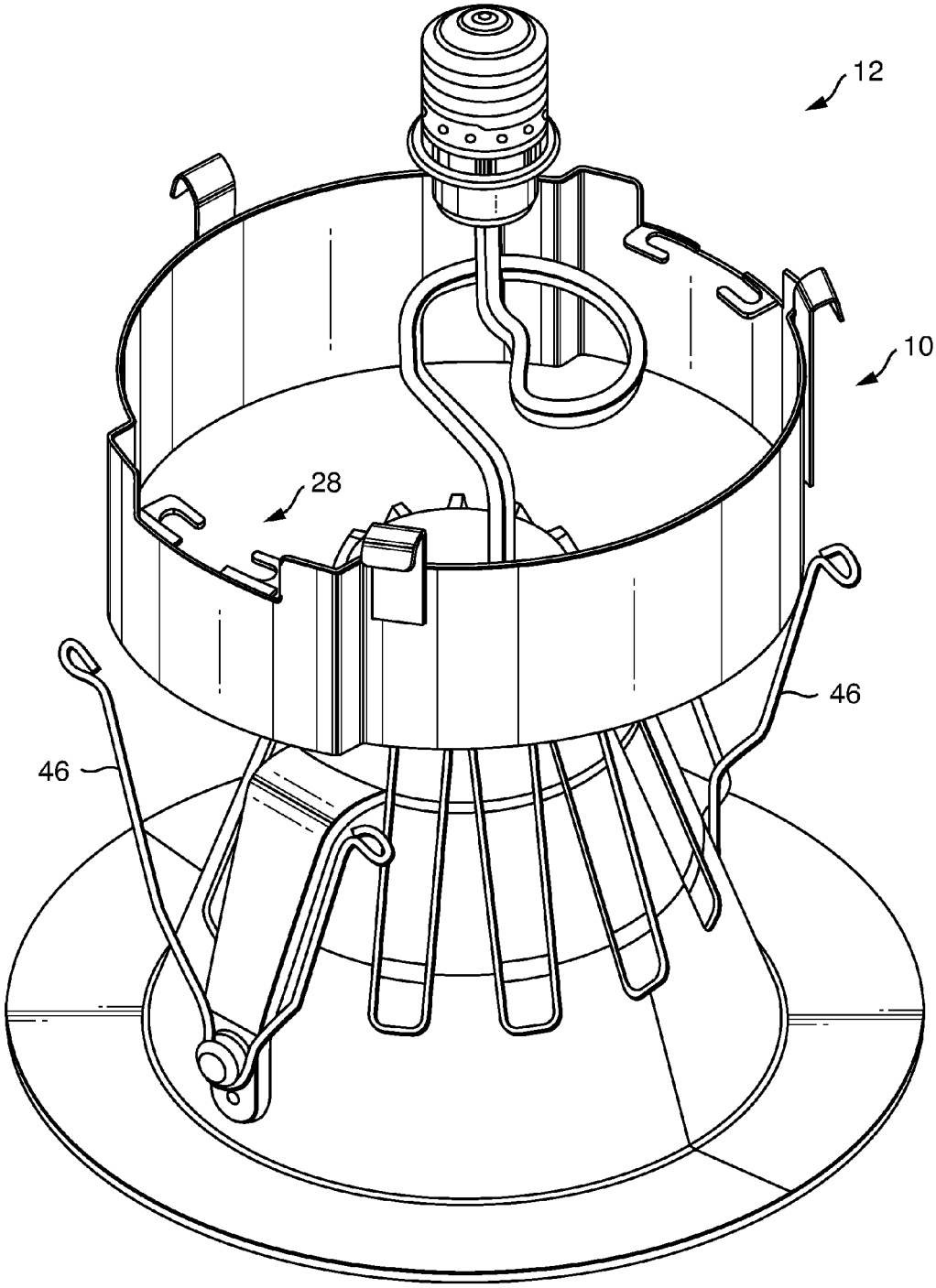
FIG. 3 is a perspective view showing the assembly of a downlight support with a downlight luminaire according to embodiments disclosed herein.
Figure 4:
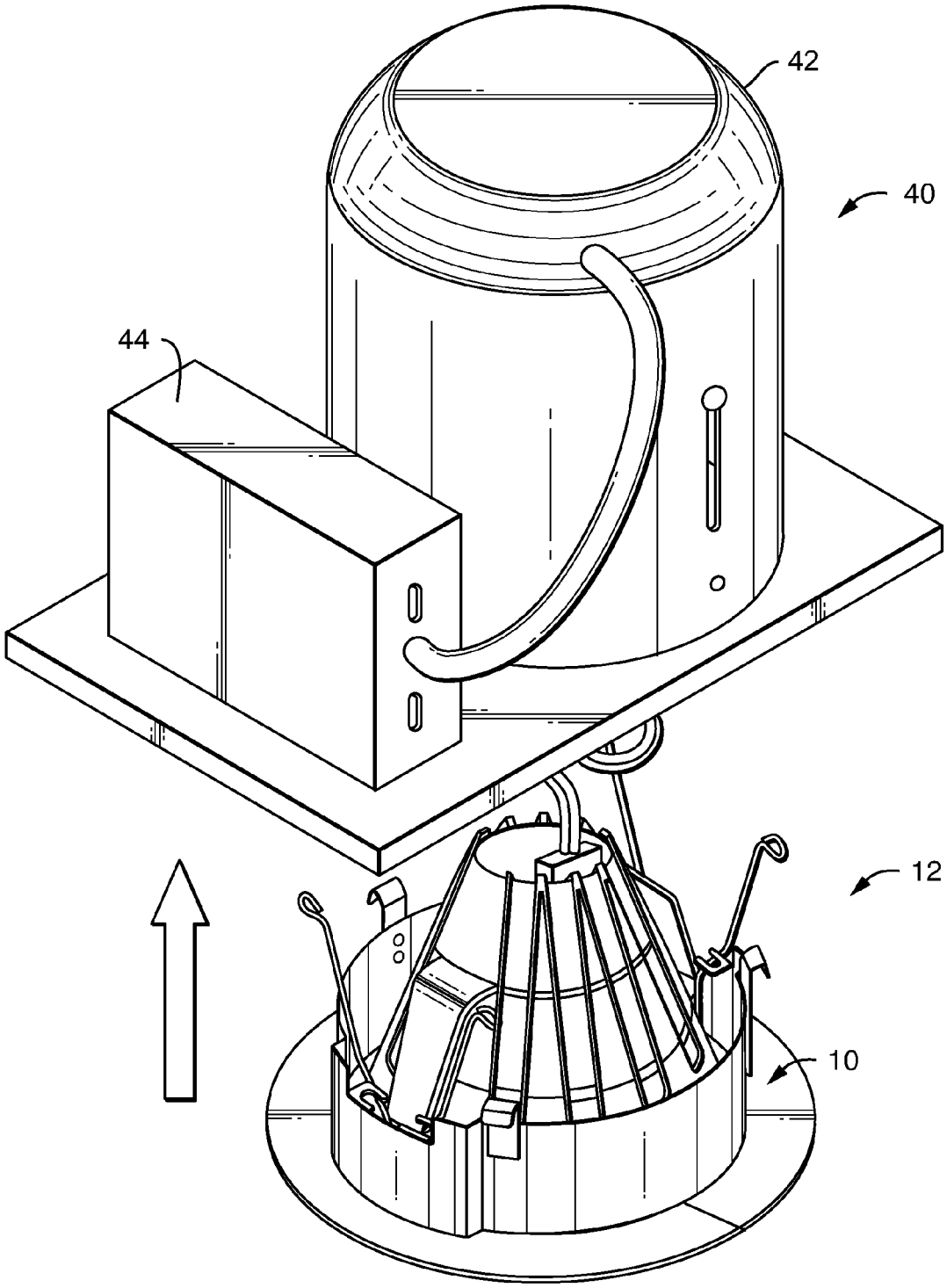
FIG. 4 is a perspective view showing the attachment of the downlight luminaire with downlight support of FIG. 3 to a recessed fixture according to embodiments disclosed herein.

FIGS. 1 and 2 show a plan view and a perspective view, respectively, of a support 10 for a downlight luminaire 12 (shown in FIGS. 3 and 4), which is to be mounted within a fixture 40 (shown in FIG. 4). The fixture 40 is a ceiling-mounted lighting fixture, such as but not limited to a recessed fixture, frequently referred to in the art as a recessed can and/or a ceiling can. The support 10 includes a tubular band 14. The tubular band 14 has a first section 16 and a second section 20. The first section 16 is defined by a first diameter 18, while the second section 20 is defined by a second diameter 22. The first diameter 18 and the second diameter 22 are arrayed about a longitudinal axis 24. The longitudinal axis 24 is located at a center and/or substantially at a center of the tubular band 14 and extends up and down from the center such that it is parallel to the tubular band 14. In some embodiments, the second diameter 22 is smaller in dimension than the first diameter 18. In some embodiments, the first diameter 18 is smaller than the second diameter 22. The reduced dimension of the second diameter 22 provides clearance for any extraneous structure that may exist in the fixture 40. In some embodiments, the second diameter 22 additionally provides for a snug fit of the support 10 on the downlight luminaire 12. The tubular band 14 is preferably made of a single piece of stamped, plated metal, such as but not limited to steel, that is joined at its edges 38. In some embodiments, the jointure is accomplished by riveting overlapped edges. In other embodiments, welding and/or any other desired joining method that will provide the necessary rigidity and desired life expectancy of the unit are used. Of course, in some embodiments, more than one joining method is used to provide for additional rigidity and life expectancy.

A plurality of leaf springs 26 are positioned on the second section 20 of the tubular band 14. Each leaf spring 26 in the plurality of leaf springs 26 extends parallel to the longitudinal axis 24 and beyond an upper rim 25 of the tubular band 14. In FIGS. 1 and 2, the support 10 includes three leaf springs 26, which are positioned at substantially 120 degrees apart. In some embodiments, more leaf springs 26 are utilized, depending on for example but not limited to, the type of fixture 40 that will receive a downlight luminaire including the support 10. The plurality of leaf springs 26 are affixed to the tubular band 14 in any desired manner, such as but not limited to by welding, riveting, and/or any known joining methods. Preferably, the plurality of leaf springs 26 are attached by riveting. Each of the leaf springs 26 has an elongated, relatively flat portion 32 that is affixed to a side 34 of the second section 20 of the tubular band 14, and an engaging end 36 formed as a projection that extends away from the longitudinal axis 24. The engaging end 36 of each leaf spring 26 comes into contact with an interior of the fixture 40. In some embodiments, the engaging end 36 is shaped so as to interact with a structure on the inside of the fixture 40. In some embodiments, the plurality of leaf springs 26 are preferably constructed from spring steel. In other embodiments, the plurality of leaf springs 26 are constructed from other metals and/or hard plastics having sufficient tensile strength to properly support a downlight luminaire to which the support 10 is attached within a fixture and/or to properly interact with the interior of the fixture and/or one or more structures on the interior of the fixture.

A pair of tension spring receptors 28 is positioned internally of the tubular band 14 on the first section 16 and extends inwardly toward the longitudinal axis 24. In FIGS. 1 and 2, the support 10 includes two pairs of tension spring receptors 28, which are arranged at substantially 180 degrees circumferentially apart on the tubular band 14. In some embodiments, the one or more pairs of tension spring receptors 28 are located at different positions on the tubular band 14 and/or spaced apart at different angles circumferentially on the tubular band 14, depending on the number and/or location of one or more tension springs of a particular type of luminaire. Each of the pair of tension spring receptors 28 comprises a pair of spaced-apart receptacles 30, each of which receive a portion of a tension spring. The tension spring thus acts on the pair of tension spring receports 28 so as to keep the support 10 engaged with the luminaire 12. In some embodiments, such as shown in FIGS. 1-4, the pair of spaced-apart receptacles 30 is a pair of spaced-apart U-shaped clips 30. In some embodiments, the pair of spaced-apart receptacles 30 takes on different shapes, for example by not limited to a pair of straight clips each having no curves, a pair of clips having triangular-shaped openings, a pair of clips having openings shaped in any other known shape, and the like. In some embodiments, each receptacle 30 in the pair of spaced-apart receptacles 30 has a different shape.

In some embodiments, each pair of tension spring receptors 28 is made of a metal and/or a hard plastic and/or combinations thereof. In some embodiments, the U-shaped clips 30 are stamped into the metal sheet that forms the tubular band 14, and then each U-shaped clip 30 is folded ninety degrees and/or substantially ninety degrees inwards toward the longitudinal axis 24.

FIG. 3 shows the support 10 of FIGS. 1 and 2 being attached to the downlight luminaire 12. The downlight luminaire 12 includes a pair of tension springs 46 affixed thereto. In some situations, the downlight luminaire 12 is able to attached to the fixture 40 of FIG. 4 through use of the pair of tension springs 46. However, when the fixture 40 lacks the appropriate structure to receive the pair of tension springs 46, the support 10 is attached to the downlight luminaire 12. To attach the support 10, each tension spring in the pair of tension springs 46 is compressed, and the tubular band 14 of the support 10 is over the luminaire 12, such that each of the pair of tensions springs 46 engages the U-shaped clips 30 of a corresponding pair of tension spring receptors 28. The downlight luminaire 12 with the support 10 attached is shown in FIG. 4.

The fixture 40 in FIG. 4 includes a can portion 42 and a power source 44. The can portion 42 receives a downlight luminaire, such as but not limited to the downlight luminaire 12 shown in FIG. 4 with the attached support 10. The power source 44 provides power to the downlight luminaire 12 after it is installed within the can portion 42. With the support 10 attached to the downlight luminaire 12, the downlight luminaire is installable within the can portion 42 of the fixture 40. The engaging ends 36 of the leaf springs 26 on the support 10 cooperate with the necessary internal structure of the can portion 42 to hold the downlight luminaire 12 in the fixture 40 without use of the attachment mechanism of the downlight luminaire 12 (i.e., the pair of tension springs 46).

The support 10 is thus easily installed on a downlight luminaire, requiring no additional screwing or bolting of accessory pieces. Assembly of the support 10 with a downlight luminaire is thus completed prior installation of the downlight luminaire within a fixture. This allows for easier installation of the downlight luminaire, as no complicated steps are required to be performed while installing the downlight luminaire in the fixture, which typically requires an installer to be on a ladder or otherwise raised into the air.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein. Further, when an element or layer is referred to as being "on," "connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present.

Although the terms "first," "second," "third" etc. may be used to describe various elements, components, regions, layers and/or sections, these elements, components, regions, layers and/or sections are not to be limited by theses terms as they are used only to distinguish one element, component, region, layer or section from another element, component, region, layer or section. Thus, a first element, component, region, layer or section could be termed a second element, component, region, layer or section without departing from the scope and teachings of the present embodiments of the invention.

Spatially relative terms, such as "beneath," "below," "upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A downlight support for a lighting fixture, comprising:

a single tubular band having a first section comprising two opposing portions that define a first diameter and a second section comprising two opposing portions that define a second diameter different the first diameter, wherein the portions of the first section alternate with the portions of the second section about a longitudinal axis of the single tubular band;

a plurality of leaf springs positioned on the second section and extending generally parallel to the longitudinal axis; and a plurality of tension spring receptors arrayed about the first section and extending generally inwardly toward the longitudinal axis.

2. The downlight support of claim 1, wherein each of the tension spring receptors comprises a pair of spaced-apart receptacles, and wherein each receptacle in the pair of spaced-apart receptacles is configured to receive a portion of a tension spring.

3. The downlight support of claim 2, wherein each receptacle is a U-shaped clip, and wherein each U-shaped clip is configured to receive a portion of a tension spring.

4. The downlight support of claim 1, wherein each of the leaf springs comprises an elongated, substantially flat portion affixed to a side of the second section and an engaging end having a projection extending away from the longitudinal axis.

* * * * *